United States Patent [19]

Grieshaber et al.

[11] Patent Number: 4,565,170

[45] Date of Patent: Jan. 21, 1986

[54] CONTROL DEVICE FOR SHUTTING OFF AN INTERNAL COMBUSTION ENGINE

[75] Inventors: Hermann Grieshaber, Stuttgart; Albrecht Sieber, Ludwigsburg; Peter Schueler, Leonberg; Helmut Steimer, Denkendorf, all of Fed. Rep. of Germany

[73] Assignee: Robert Bosch GmbH, Stuttgart, Fed. Rep. of Germany

[21] Appl. No.: 563,916

[22] Filed: Dec. 21, 1983

[30] Foreign Application Priority Data

Feb. 8, 1983 [DE] Fed. Rep. of Germany ..... 3304335

[51] Int. Cl.[4] ..... F02M 63/02

[52] U.S. Cl. ..... 123/359; 123/198 DB

[58] Field of Search ..... 123/359, 198 DB, 198 D, 123/333, 332, 497, 498, 499, 514, DIG. 11

[56] References Cited

U.S. PATENT DOCUMENTS

| | | | |
|---|---|---|---|
| 4,319,550 | 5/1982 | Ishii et al. | 123/198 DB |
| 4,361,121 | 11/1982 | Clemens et al. | 123/198 DB |
| 4,391,241 | 7/1983 | Dohshita et al. | 123/198 DB |
| 4,403,580 | 9/1983 | Bader | 123/198 DB |
| 4,452,196 | 6/1984 | Indra | 123/198 DB |

FOREIGN PATENT DOCUMENTS

| | | | |
|---|---|---|---|
| 143141 | 9/1982 | Japan | 123/359 |

*Primary Examiner*—Magdalen Y. C. Moy

*Attorney, Agent, or Firm*—Edwin E. Greigg

[57] ABSTRACT

A control device for Diesel engines with which a rapid shutoff of the latter is possible by emptying the suction chamber of the injection pump by aspiration. The control device includes a control valve, which in the operating position (I) opens up the feed line of the feed pump toward the suction chamber and in the reversed shutoff position (II) blocks this feed line between the compression side (D) of the feed pump and the suction chamber. The control valve is an electromagnetic shutoff valve. A further part of the control device is an electric fuel pump, which as a special aspirating pump is disposed in an aspiration line leading from the suction chamber back to the fuel tank. For emergency engine shutoff, the control valve, displaced into its blocking position (II), blocks the flow of fuel between the feed pump and the suction chamber, while the aspirating fuel pump that has been turned on at the same time empties the suction chamber by aspiration. The emergency shutoff takes place rapidly, thereby reliably preventing engine damage and accidents.

7 Claims, 2 Drawing Figures

18
12
12a
D
37
13
11
19
15
10
33
S
28
20
16
I
II
24
17
21
27
13
23
25
36
35
29
26
22
14
34
31
30
32

CONTROL DEVICE FOR SHUTTING OFF AN INTERNAL COMBUSTION ENGINE

BACKGROUND OF THE INVENTION

The invention is based on a control device for shutting off an internal combustion engine, in particular a Diesel engine. A control device of this kind is known from German Offenlegungsschrift 30 14 712, in which a mechanically driven feed pump, which in practice is mounted on the injection pump at the level of the camshaft, is reversable by means of an electromagnetically actuatable reversing valve, to shut off the engine. The suction chamber of the feed pump and the compression side of the feed pump are connected to the fuel tank for return of fuel to the fuel tank. As a result, fuel is abruptly withdrawn from the suction chamber of the injection pump in this reversed stopping position of the reversing valve, so that the injection pump is no longer capable of pumping fuel and the associated engine shuts off. It has been found that with this known control device the suction action of the feed pump described above does not always operate rapidly and abruptyly enough to generate a sufficiently negative pressure in the suction chamber of the injection pump. Thus, satisfactory shutoff of the engine is not assured, and the dangers of engine damage caused by excessive engine speed and an excessive fuel quantity, as well as of accidents caused by the impossibility of "negative gas feed", are not sufficiently reliably avoided.

OBJECT AND SUMMARY OF THE INVENTION

With the control device embodied according to the invention a sufficiently rapid emergency engine shutoff is assured, particularly for a Diesel engine. The additional aspiration device guarantees that the suction chamber of the injection pump will be emptied by suction as quickly as possible. It is also advantageous that the additional aspiration device can be dimensioned such that it guarantees sufficient suction in every case, even in unfavorable operating ranges of the engine, so that sufficient fuel is aspirated from the suction chamber in the briefest possible time and the engine will stop immediately.

By means of the characteristics disclosed advantageous further embodiments of and improvements to the control device disclosed are attainable. With the characteristics set forth, the control device becomes particularly simple, reliable in function and favorable in cost. This is also true of other connecting parts of the control device, because the electromagnetic shutoff valve is seated in only one section of the supply line serving as a feed line and not, as in the case of the reversing valve in the known control device described initially above, in both line sections, namely the suction and the feed line. The characteristics set forth result in a device which is particularly useful, favorable in cost and highly effective. Electric fuel pumps of this kind can be small, light and favorable in cost and at the same time have the advantage that they can be installed and controlled more simply and favorably from the standpoint of control technology. Separating the operations of fuel feeding to the feed pump and of aspiration in the case of emergency shutoff to the additional electric fuel pump affords the advantage that each pump can be adapted as optimally as possible to particular requirements and dimensioned accordingly.

Another advantageous further development is disclosed, and further advantageous characteristics thereof are recited. This form of embodiment is particularly advantageous in cases where the at least one electric fuel pump is already present as a starting fuel pump, being intended to assure the required high rate of fuel feed during the period while the starter is actuated. Such starting fuel pumps are normally in operation only during starting. In the embodiment according to the invention, they are then also used for emptying by suction in the event of an emergency shutoff, so that these fuel pumps then have a double utility. A particular advantage is also afforded if for instance an electric fuel pump or two parallel-connected electric fuel pumps entirely replace the otherwise existing, mechanically driven feed pump and simultaneously are then operated for emergency shutoff purposes by performing the operation of emptying by suction in the reversed rotational direction. Then these electric fuel pumps again assume two tasks.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
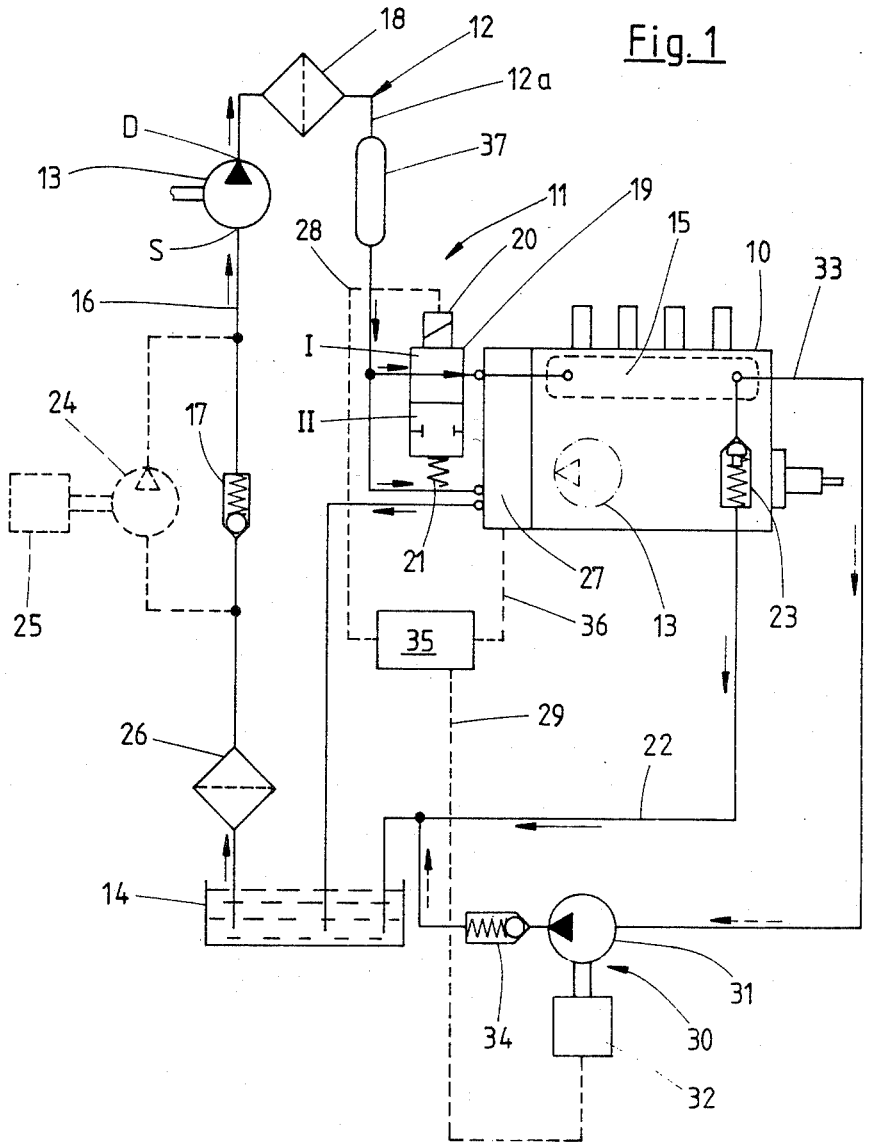
FIG. 1 is an illustration, simplified by the use of standardized circuit diagrams, of the control device according to the invention in a first exemplary embodiment.

The first exemplary embodiment shown in simplified form in FIG. 1 has a control device 11 inserted into the fuel circulation of an injection pump 10; this control device 11 serves to shut off an internal combustion engine, not shown, and in particular a Diesel engine, with which the injection pump 10 is associated. The control device 11 has a feed pump 13 connected into a supply line 12; during normal operation the feed pump 13 aspirates fuel from a fuel tank 14 and feeds it to the suction chamber 15, indicated by dashed lines, of the injection pump 10. The preferably mechanically driven feed pump 13 is a piston feed pump of a type known per se, having a suction valve and a compression valve; as indicated by the dot-dash lines in FIG. 1, in practice it is mounted on the injection pump 10 at the level of the camshaft. The part of the supply line 12 preceding the feed pump 13 represents a suction line 16, which extends between the suction side S of the feed pump 13 and the fuel tank 14 and into which a check valve 17 is inserted. A section 12*a* of the supply line 12 serves as the feed line, extending between the compression side D of the feed pump 13 and the suction chamber 15 and is provided with a fuel filter 18, a fuel reservoir 37 and a control valve 19, which is embodied as an electromagnetic shutoff valve. The control valve 19 is at the moment located in its operating position marked I, in which the valve member is held counter to the force of a restoring spring 21 by means of an electromagnet 20 being subjected to operating current. In this operating position I, the control valve 19 allows the fuel to pass through in the normal direction, as indicated by the arrows drawn in solid lines, so that the fuel reaches the suction chamber 15.

The suction chamber 15 of the injection pump 10 is connected to the fuel tank 14 via an overflow line 22, in which an overflow valve 23 is located at the outlet of the suction chamber.

An electrically driven fuel pump 24 with an electric motor 25 is connected to the suction line 16 and parallel to the check valve 17, being shown only in dashed lines because it is not absolutely required. Like the feed pump 13, this fuel pump 24 is preceded by a fuel filter 26. The electric fuel pump 24 here represents a starting fuel pump already existing in the system, which is turned on only during starting and assures the required high rate of fuel feed during the period while the starter is actuated; this fuel pump 24 is required above all if an electrohydraulic regulator final control element is used. It may be dispensed with if it is possible to meet this fuel requirement sufficiently well with the feed pump 13 alone.

The control device 11 has an additional aspiration device 30, which during aspiration and with the control valve 19 simultaneously located in the shutoff position II, has its suction side in communication with the suction chamber 15 of the injection pump and empties this suction chamber 15 by suction. The additional aspiration device here comprises at least one electric fuel pump 31 having an electromotor 32, which will herein as briefly called the aspirating fuel pump. This pump 31 is inserted into an aspiration line 33, which is connected to the outlet of the suction chamber 15 of the injection pump 10 and on the compression side of the aspirating fuel pump 31 is connected via a check valve 34 to the overflow line 22 leading back to the fuel tank 14.

The mode of operation of the control device 11 is as follows:

In the operating position I of the control valve 19 shown in FIG. 1, the feed pump 13 or, if it is omitted the electric fuel pump 24 or, if both are included in the system then both in common aspirate fuel via the suction line 16 from the fuel tank 14. The fuel is forced on the compression side via the fuel filter 18 and the fuel reservoir 37 through the feed line **12*a* and through the control valve 19 into the suction chamber 15 of the injection pump 10. Excess fuel not fed to the nozzles flows out of the suction chamber 15 via the overflow valve 23 and the overflow line 22 back to the fuel tank 14**.

For shutting off the engine, the electric fuel pump 31 is turned on and simultaneously the control valve 19 is displaced into its shutoff position II, which places the control valve 19 under the force of the restoring spring 21, as soon as the electromagnet 20 is without electric current. An electric control unit 35, shown only schematically, of a regulating member 27 functioning electrohydraulically as an injection pump regulator serves to drive both the electric fuel pump 31 on the one hand and the control valve 19 on the other. The control unit 35 is connected via a control line 28 with the electromagnet 20, via a control line 29 with the electric motor 32 and via a control line 36 with the regulating member 27. The control unit 35 responds in accordance with a control signal or a persistent feedback deviation of the injection pump regulator 27. This persistent feedback deviation takes the form, in the feedback loop of the injection pump 10, of a difference between the set-point position of the control rod, corresponding to the transducer signals, and the actual position corresponding to the control-rod travel transducer signal. If such a persistent feedback deviation persists in the regulator member 27, then the electric motor 32 is switched on and simultaneously the electromagnet 20 is de-energized. The control valve 19 moves into its shutoff position II, in which the feed line **12*a* to the suction chamber 15 of the injection pump 10 is blocked. Because the electric fuel pump 31 is turned on, the suction chamber 15 is aspirated via the aspiration line 33, so that fuel is withdrawn from the suction chamber 15 and flows back to the fuel tank 14 via the check valve 34, which is pressed open, and the remaining portion of the overflow line 22. This aspiration process is shown in FIG. 1** by arrows drawn in dashed lines.

In a modified exemplary embodiment, the control valve 19 may also be without electric current in the operating position I shown in FIG. 1 and held in this position by the restoring spring 21, while by contrast, in order to effect the switchover into the shutoff position II, the electromagnet 20 is excited and displaces the valve body into the shutoff position II and holds it there counter to the action of the restoring spring 21.

Figure 2:
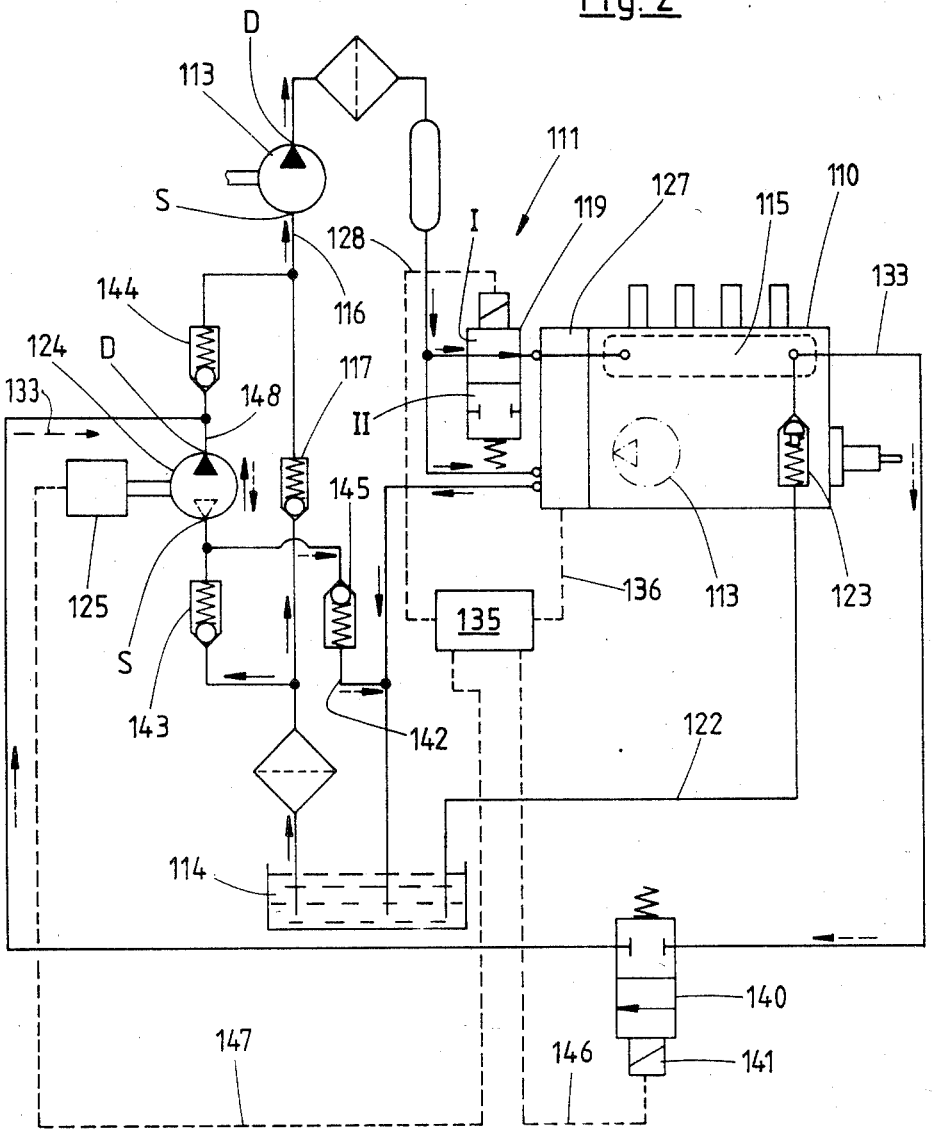
FIG. 2 is an illustration corresponding to FIG. 1 of a second exemplary embodiment.

In the second exemplary embodiment shown in FIG. 2, the elements corresponding to those of the first exemplary embodiment are identified by the same reference numerals raised by 100, and attention is drawn to the description of the first exemplary embodiment for these elements, in order to avoid repetition.

In the second exemplary embodiment a special suction fuel pump is omitted; instead, in addition to the mechanically driven feed pump 113, at least one electric fuel pump 124 with an electric motor 125 is provided, which is incorporated into a bypass line 148 provided with two check valves 143 and 144. The bypass line 148 is connected to the suction line 116 in parallel with check valve 117.

The electric motor 125 is reversable in its polarity. The fuel pump 124 can be reversed in direction. It is capable of pumping fuel in both rotational directions, with normal operation being indicated by solid lines and feeding operation in the opposite direction being indicated by dashed lines. The electric fuel pump 125 in the second exemplary embodiment shown in FIG. 2 is an already existing starting fuel pump, which is in operation only during starting and assures the required high rate of fuel feed during the period of starter actuation. So far the electric fuel pump 124 thus corresponds to that indicated by dashed lines at 24 in FIG. 1. In a modified exemplary embodiment of FIG. 2, not shown, the mechanically driven feed pump 113 is entirely lacking. Instead, the entire fuel supply function is performed by the electric fuel pump 124 shown, or by two parallel-connected electrical fuel pumps of this type.

From the suction chamber 115 of the injection pump 110, an aspiration line 133 leads as far as the section of the bypass line 148 located between the fuel pump 124 and the check valve 144, so that the aspiration line 133 discharges into the bypass line 148 on the compression side D of the electric fuel pump 124. The aspiration line 133 contains a blocking valve 140 which in the normal state effects blocking but for aspiration is openable, this blocking valve being embodied here as a magnetic valve having an electromagnet 141. A return flow line 142 extends between the fuel tank 114 and the electric fuel pump 124, being connected to the suction side S of the fuel pump 124 to the bypass line 148 and leading back to the fuel tank 114. The designations of "compression side D" and "suction side S" of the fuel pump 124 are selected for their normal feeding direction.

On each side, that is, both the compression side D and the suction side S of the electric fuel pump 124, the bypass line 148 contains one of the check valves 144, 143, opening in the feed direction marked by the arrows drawn in solid lines and acting as suction and pressure valves. The return flow line 142 is likewise provided with a check valve 145, which opens in the return flow direction back to the fuel tank 114.

From the control unit 135, one control line 128 leads to the control valve 119 and one control line 136 leads to the regulating member 127; a further control line 146 leads to the electromagnet 141 of the blocking valve 140 and finally a control line 147 leads to the electric motor 125 of the electric fuel pump 125. The control lines 128, 136, 146 and 147 are disposed as indicated by dashed lines.

For shutting off the engine, the electric motor 125 is reversed in polarity via the control line 147, so that it now revolves in the opposite direction from before and thus the electric fuel pump 124 pumps in the opposite direction from its former mode of operation, that is, in effect backward. At the same time, the control valve 119 is acted upon by the control line 128 and moved from its operating position shown into its shutoff position. Simultaneously the blocking valve 140 is also acted upon via the control line 146 such that it opens and permits access into the aspiration line 133. The result, via the electric fuel pump 124 which is now operating in the opposite direction, is an aspiration through the aspiration line 133 of fuel out of the suction chamber 115 of the injection pump 110. The aspirated fuel travels from the fuel pump 124 through the check valve 145 and the return flow line 142 in the direction indicated by the dashed arrows back to the fuel tank 114. Since the check valves 143 and 144 as well as the overflow valve 123 effect blockage in this flow direction, this aspirating flow is assured to be solely through the return flow line 142.

Both control devices described, as shown in FIGS. 1 and 2, assure a sufficient, rapid emergency shutoff of an internal combustion engine being supplied by the injection pump 10 or 110. Any engine damage that might have been caused by excessive engine speed and excessive fuel quantity as well as any accidents because of the impossibility of "negative gas feed" are thereby avoided. This is important above all when a regulating member or injection pump regulator 27 or 127, functioning either electrohydraulically or merely electrically, is used, and if this regulating member then fails as a result of either mechanical or electrical defects and the engine can no longer be shut off in the conventional manner with the regulating rod of the injection pump 10 or 110.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A control device for shutting off an internal combustion engine, in particular a Diesel engine, comprising a fuel feed pump connected to a suction line connected to a fuel supply tank which during normal operation aspirates fuel from said fuel supply tank and pumps the fuel via a feed line embodied as a section of a supply line to a suction chamber of an injection pump, an overflow line connected to said suction chamber of said injection pump and to said fuel supply tank, a first check valve located in said overflow line between said suction chamber and said fuel supply tank, an electromagnetic shutoff control valve inserted into the feed line, said control valve being reversible from an operating position (I) which allows fuel to pass through said control valve in the feeding direction to a blocking operating position (II) in which fuel flowing from a compression side (D) of the feed pump to the suction chamber of the injection pump is blocked, an aspiration line connected to said suction chamber at one end and to said overflow line at its other end, an electric fuel pump inserted into said aspiration line with its suction side connected toward said suction chamber of the injection pump, a second check valve in said aspiration line between said electric pump and said supply tank, with a compression side of said electric pump connected to one side of said second check valve with the opposite side of said second check valve connected downstream of said first check valve to said overflow line which leads back to the fuel tank, which electric fuel pump during aspiration operation with the control valve simultaneously located in the shutoff position (II) aspirates fuel from said suction chamber to stop said engine.

2. A control device as defined in claim 1 in which an electric control unit acts upon said control valve and said electric fuel pump for aspirating operation in accordance with a control signal.

3. A control device for shutting off an internal combustion engine, in particular a Diesel engine, comprision a fuel feed pump connected to a suction line connected to a fuel supply tank which during normal operation aspirates fuel from said fuel supply tank and pumps the fuel via a feed line embodied as a section of a supply line to a suction chamber of an injection pump, an overflow line connected to said suction chamber of said injection pump and to said fuel supply tank, an overflow valve located in said overflow line between said suction chamber and said fuel supply tank, a control valve inserted into the feed line, said control valve being reversible from an operating position (I) which allows fuel to pass through said control valve in the feeding direction to a blocking operating position (II) in which fuel flowing from a compression side (D) of the feed pump to the suction chamber of the injection pump is blocked, a bypass line disposed parallel with and connected to said suction line which is connected to said fuel supply tank, an electric fuel pump inserted into said bypass line and which is capable of pumping in opposite rotational directions, a return flow line connected between said fuel supply tank and said bypass line on the fuel supply tank side of said electric fuel pump, an aspiration line that leads from said suction chamber of the injection pump to said bypass line which aspiration line discharges on the side of said electric fuel pump toward said fuel feed pump and a blocking valve in said aspiration line which is openable simultaneously with changing said control valve from an operating position to a blocking position for aspirating fuel from said suction chamber to stop said engine.

4. A control device as defined by claim 3, in which said electric fuel pump comprises a starting fuel pump.

5. A control device as defined by claim 3, in which the blocking valve is embodied as a magnetic valve.

6. A control device as defined by claim 3, in which the bypass line has one check valve opening in the feeding direction on the suction side and one check valve on the fuel feed pump side of the electric fuel pump, and that the return flow line has a check valve opening in the return flow direction toward the fuel tank.

7. A control device as defined by claim 6, in which an electric control unit acts upon the control valve and the electric fuel pump for aspirating operation in accordance with a control signal.

* * * * *